United States Patent [19]

Miyaoka

[11] Patent Number: 4,986,165

[45] Date of Patent: Jan. 22, 1991

[54] HYDRAULIC SHOVEL CONTROL CIRCUIT WITH OPERATING PATTERN SWITCHING VALVE

[75] Inventor: Satoshi Miyaoka, Hiroshima, Japan

[73] Assignee: Kabushiki Kaisha Kobe Seiko Sho, Kobe, Japan

[21] Appl. No.: 400,019

[22] Filed: Aug. 29, 1989

[51] Int. Cl.[5] ..... F15B 13/08

[52] U.S. Cl. ..... 91/529; 91/522; 137/270; 137/596.15

[58] Field of Search ..... 91/522, 529, 530, 461; 137/596.15, 270

[56] References Cited

U.S. PATENT DOCUMENTS 3,817,153 9/1972 Zunzer ..... 91/529

4,738,103 4/1988 Tha ..... 91/529 X

*Primary Examiner*—John T. Kwon

*Assistant Examiner*—George Kapsalas

*Attorney, Agent, or Firm*—Oblon, Spivak, McClelland, Maier and Neustadt

[57] ABSTRACT

An operating apparatus for a hydraulic shovel for operating a plurality of control valves which control the operation of work devices includes pilot type control valves, pilot valves, levers for operating pilot valves, and an operating pattern switching valve. The operating pattern switching valve has a rotary spool inserted into a casing. A plurality of input ports are provided in a peripheral surface of the casing with phases deviated from each other axially and peripherally. A plurality of output ports are provided oppositely to the input ports.

4 Claims, 5 Drawing Sheets

HYDRAULIC SHOVEL CONTROL CIRCUIT WITH OPERATING PATTERN SWITCHING VALVE

BACKGROUND OF THE INVENTION

1. Field of the Invention

The present invention relates to an operating apparatus for operating a plurality of control valves which control the operation of a boom cylinder, an arm cylinder, a bucket cylinder and a swing motor of a hydraulic shovel.

2. Description of the Prior Art

A hydraulic shovel is generally constructed as shown in FIG. 6. In FIG. 6, the hydraulic shovel comprises a lower travel body 1, an upper swing body 2, a boom 3, an arm 4 and a bucket 5. These are operated by left and right travel motors (not shown), a swing motor 6, a boom cylinder 7, an arm cylinder 8 and a bucket cylinder 9. Left and right travelling operating levers 11, 12 and left and right operating levers 13, 14 for a work machine are provided in a driver's cab in order to operate the motors 6 and the cylinders 7, 8 and 9.

The hydraulic shovel of this kind are manufactured by several companies. However, the operating pattern thereof, that is, the corresponding relationship between the operating direction of the left and right operating levers 13 and 14 for a work machine and the cylinders 7, 8 and 9 and the swing motor 6 operated thereby differs by makers. Therefore, for example, when an operator familiar with the operating pattern of company A operates the shovel in the operating pattern of the other company, he cannot operate it smoothly due to his non-familiarity with the pattern of that company, thus lowering the work efficiency and resulting in an danger of occurrence of a trouble due to a misoperation.

Incidentally, in the hydraulic shovel, there are four typical operating patterns presently generally used. Therefore, it is desired that in a single machine, several (typically four) operating patterns can be suitably selected by a simple switching operation.

In the past, means for changing the operating patterns known include:

(a) Connection conversion type by rod and link

This type, for example, is shown in Japanese Utility Model Publication No. 45334/1983. This type is used for a manually-operated machine. Two operating levers and two sliding spools of manual control valves are convertibly connected through a plurality of push and pull rods and swing links to convert the connecting relationship therebetween to change the operating pattern.

(b) Connection conversion type of hydraulic hose

This type, for example, is shown in Japanese Utility Model Application Laid-open No. 163666/1984. It is used for a pilot-operated machine. A pipe on the operating side is connected to a plurality of pilot valves operated by left and right operating levers. A hose on the side of a control valve is connected to a pilot port of a control valve for a pilot type actuator for controlling the operation of a plurality of actuators. A plurality of communicating oil passages are provided in a fixed member arranged between each of said pipe on the operating side and the hose on the side of each control valve. The pipe on the operating side is connected to one side of each communicating oil passage. The hose on the side of the control valve is connection-convertibly connected to the other side through a quick joint type coupler, and the connecting relationship between the pipe on the operating side and the hose on the control valve side is converted to thereby change the operating pattern.

(c) Main pipeline switching type

This type, for example, is shown in Japanese Utility Model Application Laid-open No. 194262/1983, this type is used for a manually-operated machine. One or more two-position switching valves for selecting the operating pattern are provided in the midst of a main pipeline for connecting two actuators and two manual control valves for controlling the operation of both the actuators, so that the connecting relationship between each control valve and each actuator is converted by switching the two-position switching valve to change the operating pattern.

(d) Pilot pipeline switching type-1

A 8-port 2-position switching valve by a slide spool is used.

This type, for example, is shown in Japanese Utility Model Application Laid-open No. 76669/1984. This type is used for a pilot-operated machine. A 8-port 2-position switching valve provided with a slide spool is provided between two pilot valves and each pilot port (four in all) of two pilot type control valves for controlling the operation of two actuators, and the slide spool of the switching valve is made to axially slide at two positions to thereby convert the connecting relationship between each pilot valve and the pilot port of each of said control valves to change the operating pattern.

(e) Pilot pipeline switching type-2

A plurality of electromagnetic switching valves are used.

This type, for example, is shown in Japanese Patent Application Laid-open Publication No. 168904/1985. This type is used for a pilot operated machine. A plurality of electromagnetic switching valves (six 2-position switching valves) are provided between a plurality of pilot valves and each pilot port of a plurality of pilot type control valves for controlling the operation of a plurality of actuators, and the plurality of electromagnetic switching valves are switched in a predetermined combination to thereby convert the connecting relationship between each pilot valve and the pilot port of each control valve to change the operating pattern.

The above-described prior arts have the following problems.

(1) In the connection conversion type by rod and link mentioned in (a) above, it is necessary to reconnect the plurality of rods while changing the connecting position thereof in order to change the operating pattern. In addition, it is necessary to change the length of rod or replace a link member as the case may be. This causes work to be very cumbersome, and it requires much labor and a long time to change the operating pattern. There is sometimes a danger such that an actuator is operated in an unexpected direction due to an erroneous connection. Moreover, since the control valve for an actuator is of a so called direct-pull type using a rod, the connecting portion of the rod lacks flexibility. It is necessary to accurately correspond the arrangement between the lever and each control valve. A one-sided wear tends to occur in the aforesaid connecting portion or a spool of the control valve due to an error in manufacture, resulting in a poor durability and a short mechanical life.

(2) In the connection conversion type of hydraulic hose mentioned in (b) above, there can be flexibility to some extent as compared with the case of the rod in (a) above. However, the connection and conversion of the hose is very troublesome. There is not much difference from the former (a) in that it requires time and labor for the conversion work. There is also a danger in that the machine is operated in an unexpected direction due to the erroneous connection. Furthermore, there is an inconvenience in that working oil leaks around a portion where a coupler is mounted and removed. Moreover, the hose on the side of the control valve crosses when the hose is connected and replaced to produce a contact interference with each other, sometimes resulting in a difficulty in connection and conversion.

(3) In the main pipeline switching type mentioned in (c) above, a main pipeline switching valve for high pressure and large flow rate is required, which poses a problem in sealing property. An oil leakage is likely to occur in the midst of the main pipeline. Furthermore, the connecting relationship of the main pipeline is merely changed between two actuators and two control valves, and so substantially only two modes of operating patterns can be changed.

(4) In the switching type mentioned in (d) above, A pilot pipeline is switched. Therefore, a switching valve having a low pressure as compared with the (c) above can be used. However, the connecting relation is merely changed in the midst of the pilot pipeline with respect to two control valves for an actuator from two pilot valves. Therefore, substantially only two modes of operating patterns can be changed, similarly to the (c) above.

In the above-described (c) and (d), if four actuators can be operated by a single switching valve in four modes of operating patterns, a 16-port 4-position switching valve is required. However, if the switching valve is of an axial slide spool type as in the above (c) and (d), the larger the number of ports and the larger the number of positions, the longer is the spool and the greater size is the whole switching valve. It is difficult to manufacture the valve, rendering it unpractical in terms of restriction of the space for installation and the amount of operation.

(5) In the electromagnetic switching valve type mentioned in (e) above, it is possible to increase the number of operating patterns by increasing the number of the electromagnetic switching valves. However, conversely, the number of electromagnetic switching valves has to be increased in order to increase the number of operating patterns, and the number of the electromagnetic switching valves and the number of pipes and connections increase, resulting in a complicated circuit structure, a troublesome manufacture, and high cost. Moreover, the plurality of electromagnetic switching valves have to be switched in order to change the operating pattern. The switching operation is cumbersome. There involves a danger in that an unexpected work operation occurs due to an error in a switching combination. Trouble tends to occur, and maintenance is very cumbersome. Furthermore, there required a large space for installation of a number of electromagnetic switching valves. Because of this, the range of possible operating patterns in the (e) type above is three modes at most. Accordingly, even this system cannot sufficiently meet the above-described requirement.

Therefore, the machines employing the conventional types (a), (b), (c), (d) and (e) as described above involves cumbersome work such as a change in connection of the rod or hose when the change of the operating pattern takes place, or the accomplishment of inefficient work due to unfamiliarity.

As a 9-port valve in which a spool is rotated to switch to 8 positions, a fluid control valve disclosed in Japanese Utility Model Publication 13938/1974 is well known. However, this fluid control valve merely selects whether the fluid from a single inlet port is branched into a plurality of distribution ports or the fluid is alternatively introduced into each distribution port. Since a single inlet port is provided, this fluid control valve cannot be used for changing the operating pattern as described above.

The present invention has been accomplished in view of the foregoing. It is an object of the present invention to provide a switching valve operating appartus for construction machineries, in which in a single machine, several modes of operating patterns can be suitably selected by a simple switching operation; even in the case of changing into four modes of operating patterns, a single operating pattern switching valve will suffice; the number of the operating pattern switching valves and the number of connections of pipes can be considerably reduced to simplify the circuit structure and make compact a switching valve for changing the operating pattern; the restriction of an installation space or the like can be easily overcome to simply practice the apparatus; the operability and workability can be enhanced without occurrence of an oil leak or a lowering of operating feeling; fewer troubles occur; and maintenance can be easily accomplished.

SUMMARY OF THE INVENTION

For achieving the aforesaid object, the present invention provides an operating apparatus for a hydraulic shovel comprising pilot type control valves for controlling the operation of actuators for work machines including a boom cylinder, an arm cylinder, a bucket cylinder and a swing motor in the hydraulic shovel; pilot valves corresponding to pilot ports of the control valves, respectively; a plurality of operating levers for operating the pilot valves; and a single operating pattern switching valve for connecting the pilot port of each control valve with each pilot valve, wherein said operating pattern switching valve is designed so that a rotary spool is inserted into a casing rotatably and displaceably in plural positions in the range of a predetermined angle, a plurality of input ports individually connected to the pilot valves, respectively, are provided in the peripheral surface of the casing with phases deviated from each other in axially and peripherally spaced apart relation, a plurality of output ports individually connected to said pilot ports, respectively, are arranged to be diametrally opposed to said inlet ports, respectively; and the rotary spool is provided with a plurality of passages by which a plurality of diametral holes are communicated with a plurality of axial holes with an arrangement wherein a connecting relationship between each input port and each output port is converted every position.

With the above-described structure, the rotary spool of the operating pattern switching valve is merely rotated and displaced through a predetermined angle to a suitable position to convert the connecting relationship between each input port and each output port of the operating pattern switching valve, that is, the connecting relationship between each pilot valve and an pilot port of each pilot type control valve. Several modes of the operating patterns can be easily selected, and the universality is enhanced, i.e., the otherwise incompatable valve connection patterns of several manufacturers can be accommodated by a single operation pattern of the operating levers by rotation of the rotary spool. Furthermore, since the operating pattern switching valve is of the rotary type, the whole valve is compact and the single operating pattern switching valve is merely used. Therefore, the number of switching valves and the number of pipe connections can be reduced to reduce cost and save the installation space. Moreover, the inlet ports and the outlet ports of the operating pattern switching valve are arranged with phases deviated from each other not only axially but peripherally. Therefore, when the pipes with respect to the ports are connected, those adjacent to each other do not possibly interfere with each other. The pipes can be connected easily and efficiently. Less trouble occurs, and maintenance is easy.

DETAILED DESCRIPTION OF THE PREFERRED EMBODIMENTS

Figure 1:
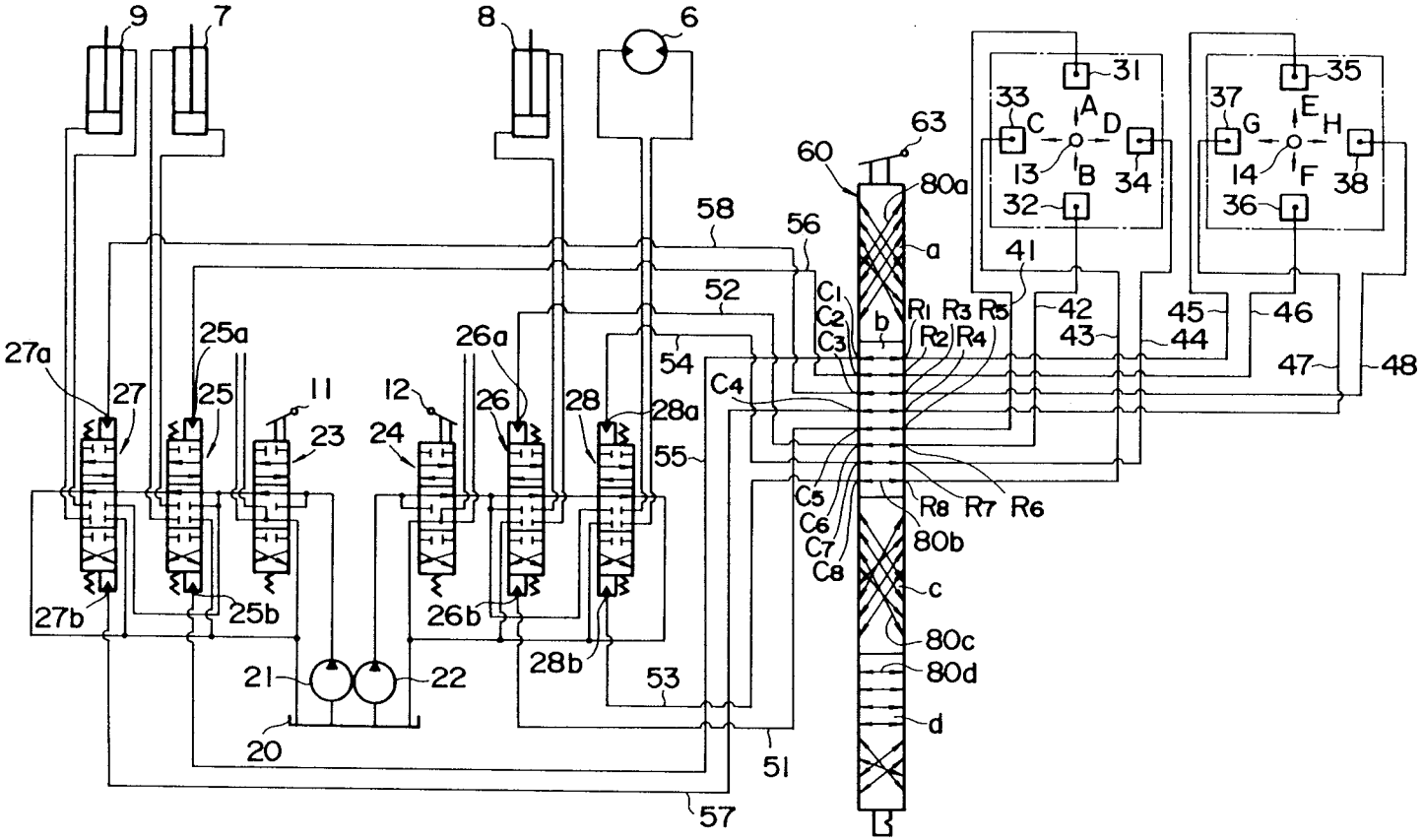
FIG. 1 is a hydraulic circuit showing an embodiment of the present invention.
Figure 2:
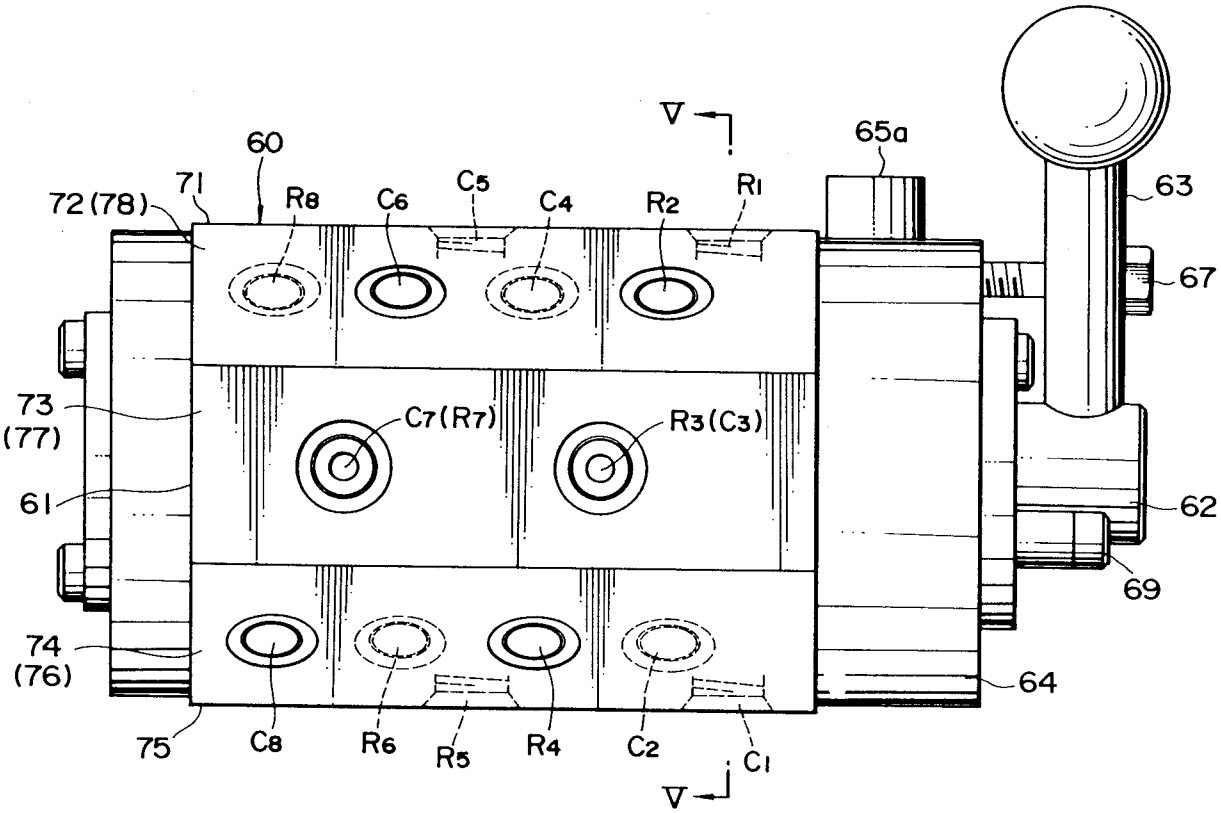
FIG. 2 is a front view showing an embodiment of an operating pattern switching valve used in the present invention.
Figure 5:
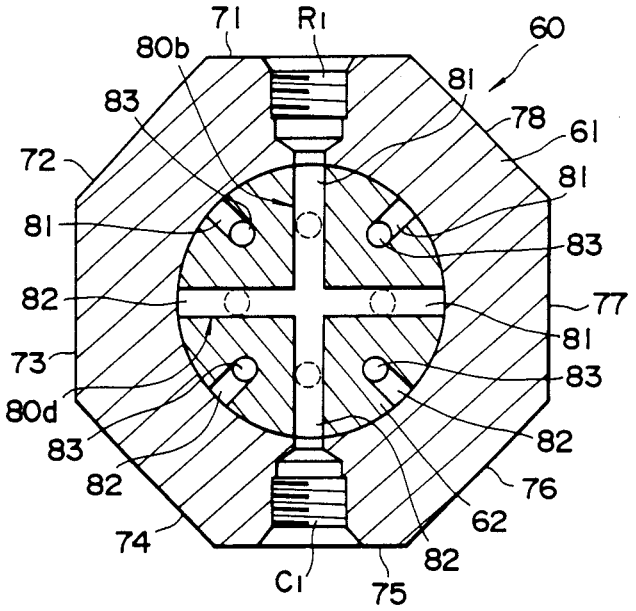
FIG. 5 is a sectional view taken on line V—V of FIG. 2.
Figure 6:
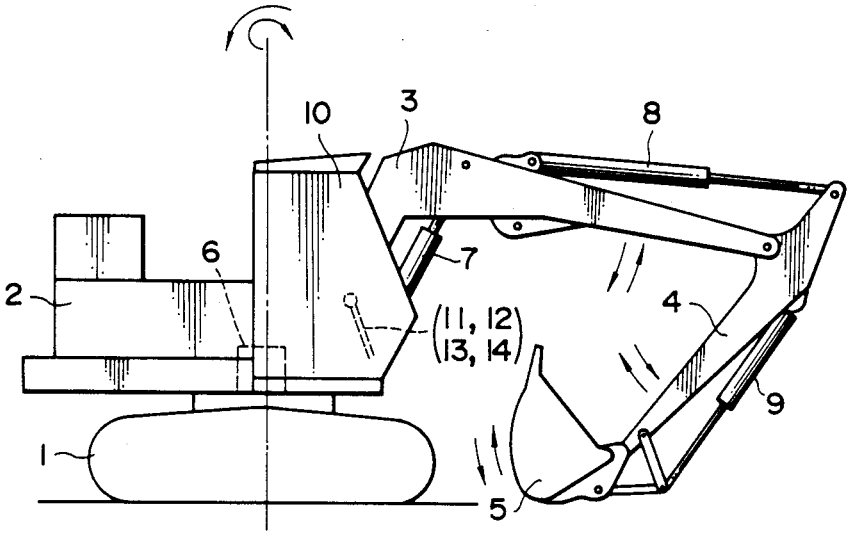
FIG. 6 is a side view showing one example of a hydraulic shovel to which the present invention is applied.

In FIG. 1 showing a hydraulic circuit, the same devices as those shown in FIG. 6 are indicated by the same reference numerals. Reference numeral 20 designates a tank, 21 and 22 hydraulic pumps, and 23 and 24 left and right travelling control valves, the control valves 23 and 24 each being operated by left and right operating levers 11 and 12 provided in a driver's cab 10 (see FIG. 5) to control the operation of left and right travel motors (not shown).

Reference numeral 25 designates a control valve for a boom, 26 a control valve for an arm, 27 a control valve for a bucket and 28 a control valve for swing. These control valves 25–28 for work machines comprise pilot type direction control valves. Pilot pressures from pilot valves 31, 32, 33, 34, 35, 36, 37 and 38 are inputted into pilot ports **25*a*, 25*b*, 26*a*, 26*b*, 27*a*, 27*b*, 28*a* and 28*b* provided on opposite ends of these valves so that the control valves 25 to 28 are switched to control the operation of the boom cylinder 7, arm cylinder 8, bucket cylinder 9 and swing motor 6**.

The pilot valves 31 to 38 comprise variable reducing valves which output pilot pressure in response to the operation of left and right operating levers 13 and 14 for work machines provided in a driver's cab 10 (see FIG. 6), which valves are provided in correspondence to all operating directions of both the levers 13 and 14. That is, the pilot valves 31, 32 and 33, 34 are operated by the operation of the left-hand lever 13 in front and rear directions A, B and in left and right directions C, D, and the pilot valves 35, 36 and 37, 38 are operated by the operation of the right-hand lever 14 in front and rear directions E, F and in left and right directions G, H.

An operating pattern switching valve 60 is to convert the connecting relationship between the pilot valves 31 to 38 and the pilot ports on the opposite ends of the control valves 25 to 28 to change the operating pattern, and is of a rotary type as shown in FIGS. 2 to 5. Thus, a single pattern of movement of the operating levers 13 and 14 can be used to operate machinery of different companies, by selecting a correct position of the operating pattern switching valve. In FIG. 1, the aforesaid connecting relationship is shown as the slide type for better understanding thereof.

The detailed construction of the operating pattern switching valve 60 will be described with reference to FIGS. 2 to 5. This operating pattern switching valve 60 is designed so that a rotary spool 62 is inserted into a casing having an octagonal cross section rotatably and displaceably in four positions a to d in the range of a predetermined angle (each 45°). In eight surfaces 71 to 78 formed in the surface of the casing 61 are arranged eight input ports $R_1$ to $R_8$ with phases deviated from each other by a constant pitch axially and circumferentially. Eight output ports $C_1$ to $C_8$ are arranged to be diametrally opposed to these eight input ports $R_1$ to $R_8$. Accordingly, the output ports $C_1$ to $C_8$ are also arranged with phases deviated from each other by a constant pitch axially and peripherally. The input ports $R_1$ to $R_8$ and output ports $C_1$ to $C_8$ are provided with phases deviated from each other by a constant pitch not only axially but peripherally in the surface of the casing 61 as described above, whereby when pipes are connected to the ports, those adjacent to each other do not interfere with each other, and the axial length of the casing 61 can be shortened, and the connection of pipes to the ports becomes easy as compared to the case where the ports are provided while being deviated only in the axial direction.

To the input ports $R_1$ to $R_8$ are connected pilot valves 31 to 38 through pilot pipelines 41 to 48 in the relationship as follows:

$R_1$-45-35,
$R_2$-46-36,
$R_3$-48-38,
$R_4$-47-37,
$R_7$-44-34,
$R_8$-43-33.

To the output ports $C_1$ to $C_8$ are connected pilot ports **25*a*, 25*b*, 26*a*, 26*b*, 27*a*, 27*b*, 28*a* and 28*b* on opposite ends of the control valves 25 to 28 through pilot pipelines 51 to 58**, respectively, in the relationship as follows:

$C_1$-**55-25*b***,
$C_2$-**56-25*a***,
$C_3$-**58-27*a***,
$C_4$-**57-27*b***,
$C_5$-**51-26*b***,
$C_6$-**52-26*a***,
$C_7$-**54-28*a***,
$C_8$-**53-28*b***.

Figure 3:
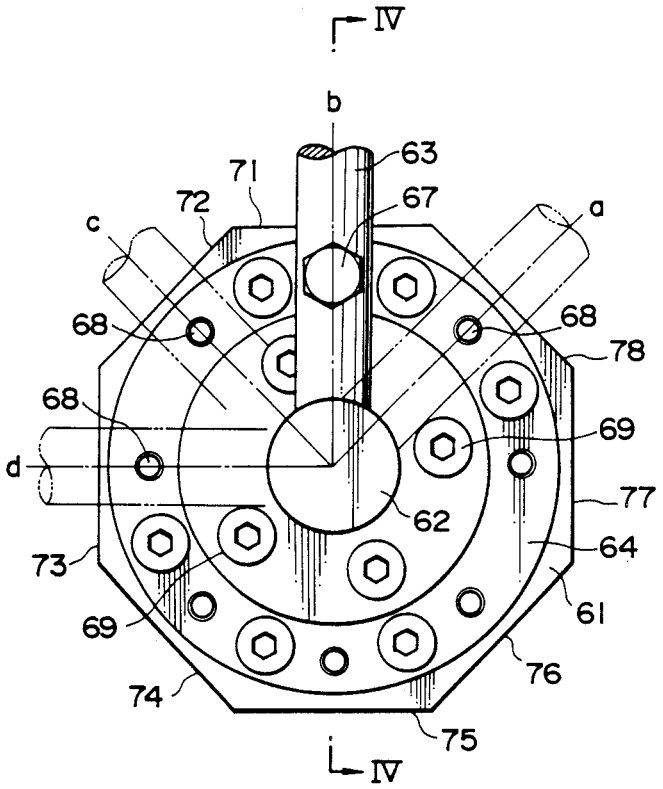
FIG. 3 is a side view thereof.
Figure 4:
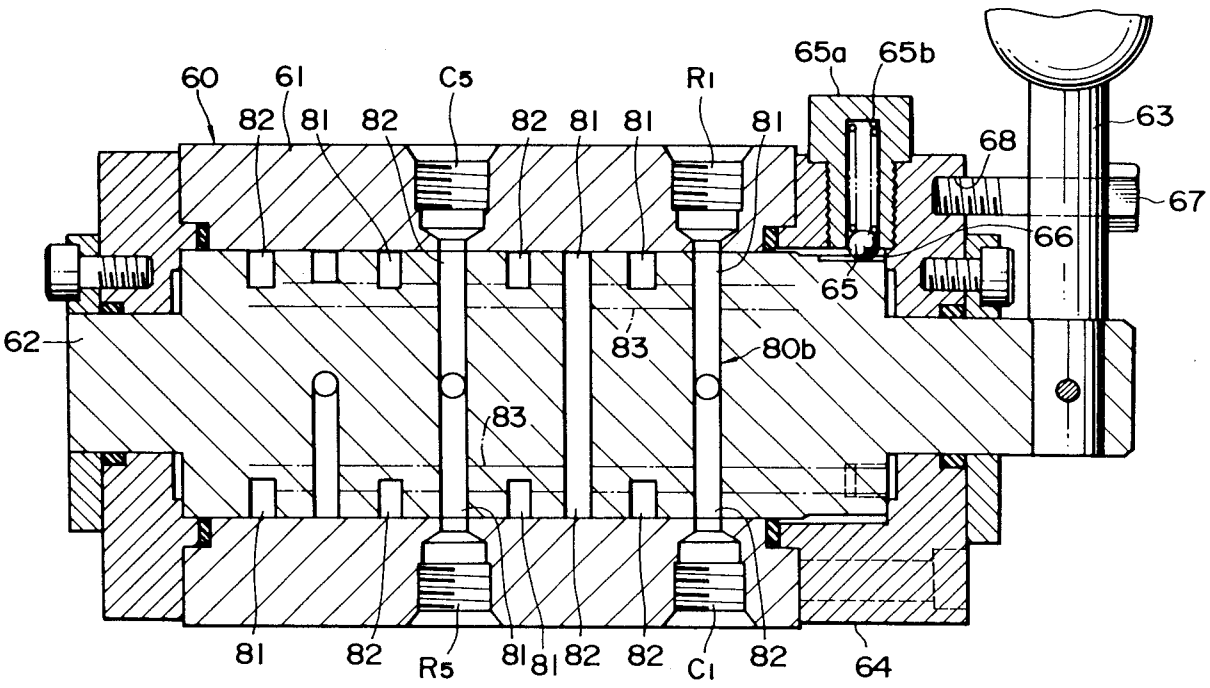
FIG. 4 is a sectional view taken on line IV—IV of FIG. 3.

On the other hand, a rotary sleeve 62 is provided to be rotatably and displaceable by a switching lever 63 provided on one end thereof to four positions, i.e., a position a at 45° clockwise, respect to a position c at 45° counterclockwise, and a position d at 90° counterclockwise with a position b shown by the full line in FIG. 3 being a reference. The rotary spool 62 is provided in every section for connecting the input ports $R_1$ to $R_8$ with the output ports $C_1$ to $C_8$, with diametral holes 81 . . . in communication with the input ports $R_1$ to $R_8$ at the positions a to d, and diametral holes 82 . . . in communication with the output ports $C_1$ to $C_8$. These holes 81 . . . and 82 . . . are communicated in states a through d in a predetermined connecting relationship in every section or communicated in a predetermined connecting relationship through a plurality of axial holes 83 . . . between the sections. The holes 81 . . . , 82 . . . and 83 . . . are combined to form passages 80*a*, 80*b*, 80*c* and 80*d* (see FIG. 1) by which the input ports $R_1$ to $R_8$ and the output ports $C_1$ to $C_8$ are communicated in the connecting relationship corresponding to four operating patterns at the positions a to d, respectively.

The input port $R_1$ and the output port $C_1$ will be described. The diametral holes 81 . . . and 82 . . . and the axial holes 83 . . . are provided so that when the rotary spool 62 is at the positions b and d, the input port $R_1$ and the output port $C_1$ are communicated with each other, when at the position a, the input port $R_1$ and the output port $C_1$ are respectively communicated with the output port $C_5$ and the input port $R_5$ in the other section, and when at the position c, the input port $R_1$ is communicated with the output port $C_6$ in another section and the output port $C_1$ is communicated with the input port $R_5$ in another section. The passages 80*a* to 80*d* composed of the diametral holes 81 . . . and 82 . . . and the axial holes 83 . . . similar to the former are formed so that other input ports $R_2$ to $R_8$ and other output ports $C_2$ to $C_8$ are communicated in a predetermined connecting relationship at positions a to d in the same way as described above. It is to be noted that the holes 81 . . . and 82 . . . may be communicated through peripheral grooves (not shown) in the range of a predetermined angle.

The relationship between the input ports $R_1$–$R_8$ and the output ports $C_1$–$C_8$ in the positions a–d of the operating pattern switching valve 60 is shown below:

TABLE 1

| | Position | | | |
|---|---|---|---|---|
| | a | b | c | d |
| $R_1$ | $C_5$ | $C_1$ | $C_6$ | $C_1$ |
| $R_2$ | $C_6$ | $C_2$ | $C_5$ | $C_2$ |
| $R_3$ | $C_7$ | $C_3$ | $C_7$ | $C_3$ |
| $R_4$ | $C_8$ | $C_4$ | $C_8$ | $C_4$ |
| $R_5$ | $C_1$ | $C_5$ | $C_1$ | $C_7$ |
| $R_6$ | $C_2$ | $C_6$ | $C_2$ | $C_8$ |
| $R_7$ | $C_4$ | $C_7$ | $C_4$ | $C_6$ |
| $R_8$ | $C_3$ | $C_8$ | $C_3$ | $C_5$ |

As described above, the rotary spool 62 of the operating pattern switching valve 6 is rotated and displaced through a predetermined angle (45°) to switch to four positions a–d, the connecting relationship between the input ports $R_1$ to $R_8$ and the output ports $C_1$ to $C_8$ can be converted to the connecting relationship corresponding to four operating patterns, and the passages 80*a* to 80*d* for switching are formed by the combination of the plurality of diametral holes 81 . . . , 82 . . . and the plurality of axial holes 83 . . . , whereby as compared with the conventional slide spool type, the rotary spool 62 can be miniaturized, the whole valve can be formed into a small configuration, the amount of switching operation (angle) for changing the operating pattern can be made small, and the operation can be easily accomplished.

A ball 65 is supported on a valve cover 64 of the operating pattern switching valve 60 through a plug 65*a* and a spring 65*b*. The ball 65 is disengageably engaged with engaging portions 66 . . . provided at positions corresponding to the positions a to d. The rotary spool 62 is detented at the positions a to d and a locking bolt 67 provided on the switching lever 63 is detachably engaged with threaded holes 68 provided at positions corresponding to the positions a to d of the valve cover 64 so that the rotary spool 62 is locked at the positions.

In the hydraulic shovel constructed as described above, when the operating pattern switching valve 60 is held at the position b shown and the left-hand operating lever 13 is operated in the direction of arrow A, the pilot pressure according to the lever operating amount is guided from the pilot valve 31 to the pilot pipeline 41→input port $R_5$ of the operating pattern switching valve 60→output port $C_5$→pilot pipeline 51→pilot port 26*b* so that the control valve 26 for arm the is switched to the lower position as viewed in the figure, the oil discharged from the hydraulic pump 22 is guided into an oil reservior on the side of the rod of the arm cylinder 8 to contract the cylinder 8 and the arm 4 shown in FIG. 6 is rotated counterclockwise. When the operating lever 13 is operated in the direction of arrow B, the arm 4 is rotated clockwise.

When the operating lever 13 is operated in the direction of arrow C, the pilot pressure according to the lever operating amount is guided from the pilot valve 33 to the pilot pipeline 43→input port $R_8$ of the operating pattern switching valve 60→outport $C_8$→pilot pipeline 53→pilot port 28*b* so that the swinging control valve 28 is switched to the lower position as viewed in the figure, the oil discharged from the hydraulic pump 22 is guided to the swing motor 6 to swing the motor 6 leftward, and the swinging work in which the upper swing body 2 swings leftward in FIG. 6 takes place. When the operating lever 1 is operated in the direction of arrow D, the swinging work in which the upper swing body 2 swings rightward takes place.

When at the position b, when the right hand operating lever 14 is operated in the direction of arrow E, the pilot pressure according to the lever operating amount is guided from the pilot valve 35 to the pilot pipeline 45→input port $R_1$ of the operating pattern switching valve 60→output port $C_1$→pilot pipeline 55→pilot port 25*b* so that the control valve 25 for boom is switched to the lower position as viewed in the figure, the oil discharged from the hydraulic pump 21 is guided into the oil reservoir on the side of rod of the boom cylinder 7 to contract the cylinder 7, and the boom 3 of FIG. 6 rotates clockwise. When the operating lever 14 is operated in the direction of arrow F, the boom raising 3 rotates counterclockwise.

When the opeating lever is operated in the direction of arrow G, the pilot pressure according to the lever operating amount is guided from the pilot valve 37 to the pilot pipeline 47→input port $R_4$ of the operating pattern switching valve 60→output port $C_4$→pilot pipeline 57→pilot port 27*b* so that the control valve 27 for the bucket is switched to the lower position as viewed in the figure, the oil discharged from the hydraulic pump 21 is guided into the oil reservoir on the side of head of the bucket cylinder 9 to extend the cylinder 9, and the excavating work in which the bucket 5 rotates clockwise takes place. When the operating lever is operated in the direction of arrow H, the releasing work in which the bucket 5 rotates counterclockwise takes place. In the manner as described above, work is carried out according to the operating directions A to H of the operating levers 13 and 14.

Next, when the operating pattern switching valve 60 is switched to the respective positions a, c and d, the connecting relationship between the input ports $R_1$ to $R_8$ and the output ports $C_1$ to $C_8$ is converted as shown in Table 1. With this, the connecting relationship between the pilot valves 31 to 38 and the control valves 25 to 28 is converted so that the operating pattern is changed and the relationship between the operating directions A to H of the operating levers 13 and 14 and the work elements is changed. The relationship between the lever operating directions A to H at the positions a to d, the pilot valves 31 to 38, the input ports $R_1$ to $R_8$ of the operating pattern switching valve 60, the output ports $C_1$ to $C_8$, the pilot ports 252, **25*b*, 26*a*, 26*b*, 27*a*, 27*b*, 28*a*, 28*b* of the control valves 25 to 28** and the work elements is shown below.

(1) Position a (System of Company A)
A: 31→$R_5$→$C_1$→**25*b***=boom-down
B: 32→$R_6$→$C_2$→**25*a***=boom-up
C: 33→$R_8$→$C_3$→**27*a***=bucket-release
D: 34→$R_7$→$C_4$→**27*b***=bucket-excavation
E: 35→$R_1$→$C_5$→**26*b***=arm-push
F: 36→$R_2$→$C_6$→**26*a***=arm-pull
G: 37→$R_4$→$C_8$→**28*b***=swing-left
H: 38→$R_3$→$C_7$→**28*a***=swing-right
(2) Position b (System of Company B)
A: 31→$R_5$→$C_5$→**26*b***=arm-push
B: 32→$R_6$→$C_6$→**26*a***=arm-pull
C: 33→$R_8$→$C_8$→**28*b***=swing-left
D: 34→$R_7$→$C_7$→**28*a***=swing-right
E: 35→$R_1$→$C_1$→**25*b***=boom-down
F: 36→$R_2$→$C_2$→**25*a***=boom-up
G: 37→$R_4$→$C_4$→**27*b***=bucket-excavation
H: 38→$R_3$→$C_3$→**27*a***=bucket-release
(3) Position c (System of Company C)
A: 31→$R_5$→$C_1$→**25*b***=boom-down
B: 32→$R_6$→$C_2$→**25*a***=boom-up
C: 33→$R_8$→$C_3$→**27*a***=bucket-release
D: 34→$R_7$→$C_4$→**27*b***=bucket-excavation
E: 35→$R_1$→$C_6$→**26*a***=arm-pull
F: 36→$R_2$→$C_5$→**26*b***=arm-push
G: 37→$R_4$→$C_8$→**28*b***=swing-left
H: 38→$R_3$→$C_7$→**28*a***=swing-right
(4) Position d (System of Company D)
A: 31→$R_5$→$C_7$→**28*a***=swing-right
B: 32→$R_6$→$C_8$→**28*b***=swing-left
C: 33→$R_8$→$C_5$→**26*b***=arm-push
D: 34→$R_7$→$C_6$→**26*a***=arm-pull
E: 35→$R_1$→$C_1$→**25*b***=boom-down
F=36→$R_2$→$C_2$→**25*a***=boom-up
G: 37→$R_4$→$C_4$→**27*b***=bucket-excavation
H=38→$R_3$→$C_3$→**27*a*=bucket-release The operating pattern switching valve 60 can be switched to thereby select the system of Company A at the position a, the system of Company B at the position b, the system of Company C at the position c and the system of Company D at the position d, and four operating patterns. If the operating levers 13 and 14 are operated in the directions of A to H in the state wherein the operator switches the operating pattern switching valve 60** to the positions a to d corresponding to the desired operating pattern, the work according to the aforesaid pattern can be effected.

As described above, according to the present invention, the rotary type operating pattern switching valve is used, and the rotary spool is rotated and displaced in the range of a predetermined angle to switch to a plurality of positions whereby several operating patterns can be suitably selected by a single machine. Thereby the following effects may be obtained.

i. One of several operating patterns can be suitably selected merely by rotating the rotary spool of the operating pattern switching valve through a predetermined angle. Therefore, the operating pattern changing work can be carried out in a short period of time and without error as compared with the connection conversion type by the rod mentioned in the above conventional art (a) and the hose connection conversion type mentioned in the (b) above. There is involved no work of removing a coupler portion, and therefore, working oil does not spill out.

ii. The operating patterns can be suitably changed by use of a single operating pattern switching valve. Therefore, the number of switching valves installed to change the operating pattern and the number of connections of pipes can be considerably reduced to simplify the structure of the circuit as compared with the aforementioned conventional art (e) which uses the electromagnetic switching valve. The apparatus can be easily fabricated, and cost can be considerably reduced.

iii. The spool of the operating pattern switching valve is of a rotary type. Therefore, the spool can be shortened, the operating amount is small and the operability can be considerably enhanced as compared with the above-described conventional arts (c) and (d) in which the operating pattern is changed by the slide of the slide type spool. Further, the whole operating pattern switching valve is compact and the restriction in the installation space can be easily overcome. The apparatus can be installed very effectively even in a narrow space such as a driver's cab of construction machineries.

iv. The input ports and output ports of the operating pattern switching valve are provided with phases deviated by a constant pitch not only axially but peripherally in the surface of the casing. Therefore, when pipes are connected to the ports, those adjacent to each other do not interfere with each other. The axial length of the casing can be shortened as compared with the case where the ports are deviated only in the axial direction. The pipes can be connected to the ports very efficiently. Less trouble occurs and maintenance is easy.

The operation and effect mentioned in the i, ii, iii and iv can be exhibited simultaneously. Therefore, switching of four operating patterns, which has been heretofore considered to be difficult, can be easily realized, and the universality can be enhanced.

What is claimed is:

1. An operating apparatus for a hydraulic shovel, comprising:

pilot type control valves for controlling the operation of actuators for work elements including a boom cylinder, an arm cylinder, a bucket cylinder and a swing motor;

pilot valves of a number corresponding to pilot ports of the control valves;

a plurality of operating levers operatively connected to said pilot valves for operating the pilot valves; and a single operating pattern switching valve connected to fluid conduits for fluidically connecting the pilot port of each control valve with a selected pilot valve, wherein said operating pattern switching valve comprises a casing, a rotary spool inserted into said casing so as to be rotatably displaceable into plural angular positions within a predetermined angular range, wherein a plurality of input ports of said switching valve individually connected to the respective pilot valves are provided in the peripheral surface of the casing at positions deviated from each other in axially and circumferentially spaced apart relation, wherein a plurality of output ports of said switching valve individually connected to the respective pilot ports are arranged to be diametrally opposed to respective ones of the inlet ports, and wherein the rotary spool is provided with a plurality of passages including a plurality of diametral holes communicated with a plurality of axial holes, whereby a connecting relationship between each input port and each output port of said switching valve is converted by rotation of said rotary spool.

2. The apparatus according to claim 1, wherein each said control valve comprises a pilot type direction control valve.

3. The apparatus according to claim 1, wherein each said pilot valve comprises a variable pressure reducing valve.

4. The apparatus according to claim 1, including a valve cover for the operating pattern switching valve, having a ball supported thereon via a plug and a spring.

* * * * *